US007454282B2

(12) United States Patent
Mizuguchi

(10) Patent No.: US 7,454,282 B2
(45) Date of Patent: Nov. 18, 2008

(54) ENGINE OUTPUT CONTROL DEVICE AND ENGINE OUTPUT CONTROL METHOD FOR WORKING MACHINE

(75) Inventor: Tetsuhisa Mizuguchi, Mooka (JP)

(73) Assignee: Komatsu Ltd., Tokyo (JP)

( * ) Notice: Subject to any disclaimer, the term of this patent is extended or adjusted under 35 U.S.C. 154(b) by 46 days.

(21) Appl. No.: 11/664,100

(22) PCT Filed: Oct. 20, 2005

(86) PCT No.: PCT/JP2005/019280

§ 371 (c)(1),
(2), (4) Date: Mar. 29, 2007

(87) PCT Pub. No.: WO2006/043619

PCT Pub. Date: Apr. 27, 2006

(65) Prior Publication Data

US 2008/0092849 A1 Apr. 24, 2008

(30) Foreign Application Priority Data

Oct. 21, 2004 (JP) ..... 2004-307133

(51) Int. Cl.
*F02D 29/02* (2006.01)

(52) U.S. Cl. ..... 701/102; 477/97

(58) Field of Classification Search ..... 701/102, 701/104, 114, 115, 50, 29, 51; 477/97, 111, 477/121; 123/357

See application file for complete search history.

(56) References Cited

U.S. PATENT DOCUMENTS 5,469,646 A * 11/1995 Takamura ..... 701/50
6,161,522 A * 12/2000 Fuchita et al. ..... 123/357
6,582,340 B1 * 6/2003 Arie et al. ..... 477/97

FOREIGN PATENT DOCUMENTS

| | | |
|---|---|---|
| JP | A-1-280641 | 11/1989 |
| JP | A-8-218442 | 8/1996 |
| JP | A-10-89111 | 4/1998 |
| JP | A-2000-314327 | 11/2000 |
| JP | A-2002-322926 | 11/2002 |
| JP | 2004-190615 A | 7/2004 |

OTHER PUBLICATIONS

European Patent Office Extended Search Report dated Feb. 22, 2008, for corresponding Application No. EP 05795595.7.

* cited by examiner

*Primary Examiner*—Hieu T Vo
(74) *Attorney, Agent, or Firm*—Posz Law Group, PLC

(57) ABSTRACT

An engine output control device and an engine output control method for a working vehicle capable of implementing low fuel consumption, and of providing the output required for working. The engine output control device of includes a mode setting switch which can set any one from among a plurality of output modes, a load detector which detects the load on the working vehicle, and an engine controller which controls an engine based on any one engine output characteristic selected from among a plurality of engine output characteristics which are prepared in advance.

10 Claims, 16 Drawing Sheets

ENGINE OUTPUT CONTROL DEVICE AND ENGINE OUTPUT CONTROL METHOD FOR WORKING MACHINE

TECHNICAL FIELD

The present invention relates to an engine output control device and an engine output control method for a working vehicle.

BACKGROUND ART

From the past, with a working vehicle such as a construction machine or the like, a technique has been known in which a plurality of output modes are provided to the engine, and the user sets one of these output modes, according to the magnitude of the output which is required for working. For example, according to Patent Document #1, the working vehicle has two output modes: a power mode in which high output can be obtained, and a standard mode in which a lower output can be obtained.

The user sets one of these output modes manually by actuating a mode setting switch or the like. In other words, if the user has decided that the work which is henceforth to be performed is heavy work, then the user selects the power mode. Conversely, if the user has decided that the work which is henceforth to be performed is light work, then the user selects the standard mode.

An engine controller which controls the engine controls the output of the engine based on the command from the mode setting switch. In other words, in the standard mode, the output of the engine is limited so as to be less than or equal to a predetermined value, for example by restricting the fuel or the like. On the other hand, in the power mode, the engine controller imposes no particular limitation, so that the output of the engine is controlled so as to obtain any output up to its rated output or its maximum output.

By doing this, light work is performed with a small engine output, so that the amount of energy consumed is reduced, and it is possible to anticipate a reduction of the fuel consumption. And, by arranging not to impose any limitation on the output of the engine during heavy working, it is possible to obtain the required output for such working.

Patent Document 1: Japanese Patent Laid-Open Publication Heisei 8-218442.

However, there are problems with this prior art technique, as will now be explained.

That is to say, with a working vehicle, it is not the case that heavy working only, or light working only, is performed continuously; rather, it is usually the case that, during a series of working processes, heavy working and light working are performed alternatingly. For example, with a dump truck, loaded running in a state in which a load is loaded on the vehicle, and empty running in a state in which the load is discharged, are alternatingly repeated. This loaded running corresponds to heavy working while the empty running corresponds to light working.

According to the prior art, each time a change over takes place between heavy working and light working, the user must change over the output mode by actuating the mode setting switch. Since it is very troublesome to perform such a task during working, it often happens that the user does not change over the mode setting switch, so that working is performed with the output mode being constant at one of the power mode or the standard mode. As a result, the problems occur that it may be impossible to implement reduction of the fuel consumption, or that it may not be possible to obtain the required power output.

DISCLOSURE OF THE INVENTION

The present invention has been conceived with a view to the above described problems, and it takes as its object to provide an engine output control device for a working vehicle, and an engine output control method, which can implement low fuel consumption, along with ensuring the necessary engine output which is required for working.

In order to achieve the above described object, the engine output control device for a working vehicle according to a first aspect of the present invention is an engine output control device for a working vehicle, characterized by comprising a mode setting switch which can set any one from among a plurality of output modes; a load detector which detects the load on a working vehicle; and an engine controller which controls an engine based on any one engine output characteristic selected from among a plurality of engine output characteristics which are prepared in advance; wherein the engine controller makes a plurality of engine output characteristics corresponding to at least one output mode among the plurality of output modes, and if an output mode which is made corresponding to the plurality of engine output characteristics is set by the mode setting switch, the engine controller selects any one among the plurality of engine output characteristics based on the magnitude of the load which is detected by the load detector.

The load detector may detect the load based on the pressure of the suspension of the working vehicle.

Or, the load detector may detect the load based on the weight of a load which is loaded on the working vehicle.

The load detector may also include a loaded weight measurement device which measures the weight of the load which is loaded on the working vehicle, based on the pressures applied to each of a plurality of suspension cylinders of the working vehicle, and on the vehicle body angle of the working vehicle.

Furthermore, the load detector may also detect the load, based on the accelerator opening degree and the acceleration of the working vehicle.

The load detector may also detect the load by utilizing information for load detection in which a high load region and a low load region are set in advance, based on a relationship between the accelerator opening degree and the acceleration.

The output modes may include a first output mode in which the engine output is relatively increased and a second output mode in which the engine output is relatively decreased. And, in the first output mode, at least a first high load engine output characteristic, which is used when the detected load is high load, is made corresponding to a first low load engine output characteristic which is used when the detected load is low load, and in which the engine output is decreased below the engine output in the first high load engine output characteristic. Moreover, in the second output mode, at least a second high load engine output characteristic, which is used when the detected load is high load, is made corresponding to a second low load engine output characteristic which is used when the detected load is low load, and in which the engine output is decreased below the engine output in the second high load engine output characteristic.

The engine controller sets the second output mode as the initial value when the engine is started, and, if the mode setting switch is actuated by a user, sets an output mode among the first output mode and the second output mode, which is selected by the user.

And the engine output control method for a working vehicle according to another aspect of the present invention is one in which: the load on a working vehicle is detected, and a plurality of output modes which can be selected by a user are provided; a plurality of engine output characteristics are made corresponding to at least one output mode among the plurality of output modes; and, when an output mode which is made corresponding to the plurality of engine output characteristics is selected by the user, any one of the plurality of engine output characteristics is selected based on the magnitude of the load which is detected.

Moreover, the engine output control device for a working vehicle according to yet another aspect of the present invention is one in which a plurality of engine output characteristics are made corresponding in advance to a first output mode in which the engine output is relatively increased and a second output mode in which the engine output is relatively decreased, respectively, and which comprises: a step of detecting the load on a working vehicle when the first output mode is selected by a user; a step of, when the detected load belongs to a high load which is set in advance, setting a first high load engine output characteristic which is made corresponding in advance to the first output mode; a step of, when the detected load belongs to a low load which is set in advance, setting a first low load engine output characteristic which is made corresponding in advance to the first output mode, and in which the engine output is decreased below the engine output in the first high load engine output characteristic; a step of detecting the load on the working vehicle when the second output mode is selected by the user; a step of, when the detected load belongs to a high load which is set in advance, setting a second high load engine output characteristic which is made corresponding in advance to the second output mode; and a step of, when the detected load belongs to a low load which is set in advance, setting a second low load engine output characteristic which is made corresponding in advance to the second output mode, and in which the engine output is decreased below the engine output in the second high load engine output characteristic.

According to the present invention, if the user sets the output mode according to the details of the work to be done, it is possible to obtain the necessary output which is required. Moreover, since the engine output characteristic is automatically selected according to the load, from among the plurality of engine output characteristics which correspond to this output mode, accordingly there is no production of useless engine output, and this contributes to improvement of fuel consumption.

Furthermore in the case of, for example, a working vehicle such as a dump truck or the like, it is possible to detect the load in an accurate manner by detecting the load based on the pressure of the suspension.

Moreover, by using an output mode in which the output of the engine is lower as an initial value, it is possible to prevent useless engine output and to improve the fuel consumption, even in a case such as one in which the user has forgotten to perform change over operation of the output mode.

BEST MODE FOR CARRYING OUT THE INVENTION

Figure 1:
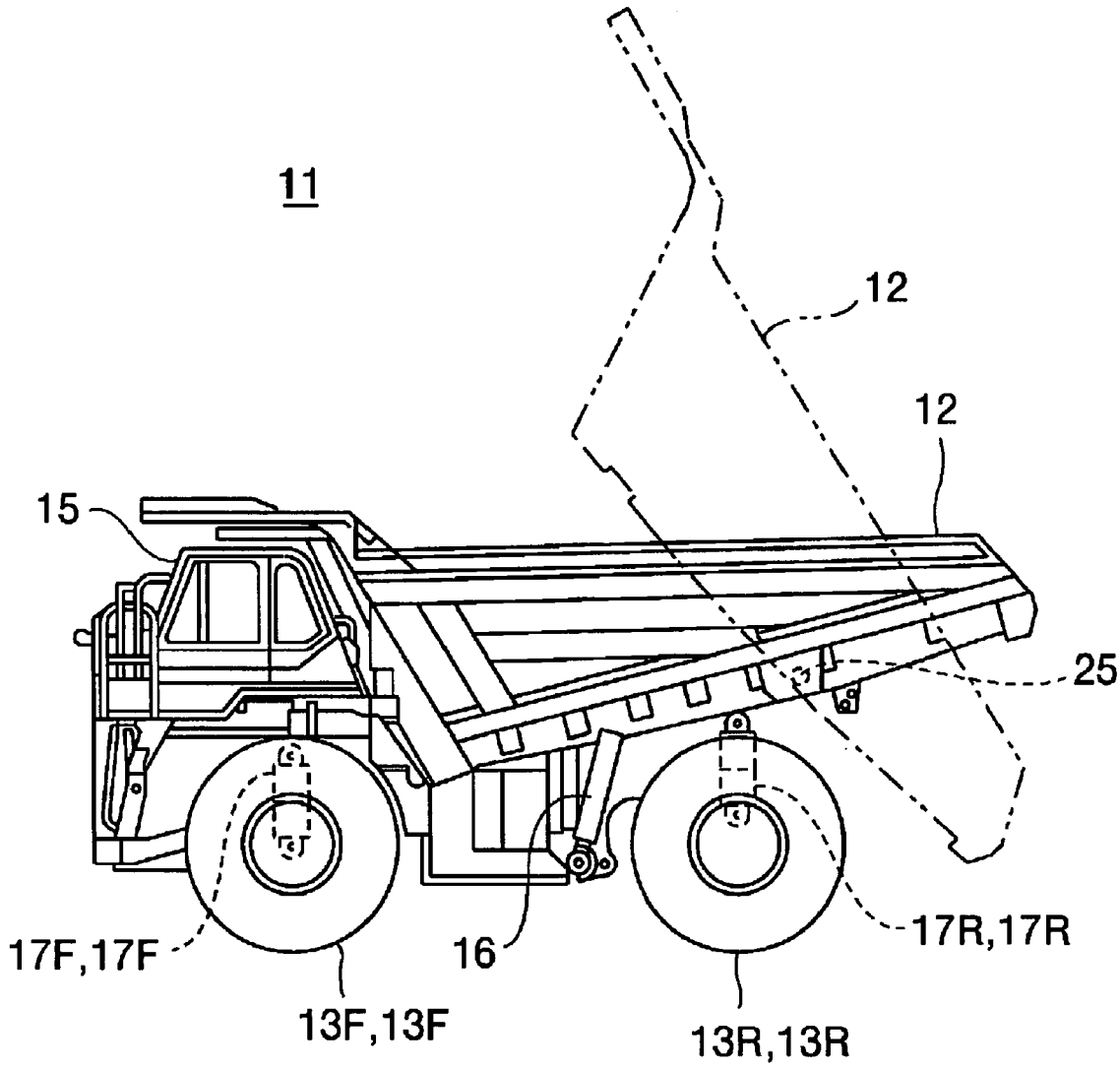
FIG. 1 is a side view of a dump truck according to an embodiment of the present invention.

Embodiments of the present invention will now be explained in detail in the following with reference to the drawings. In these embodiments, a dump truck will be explained as an example of a working vehicle. FIG. 1 shows a side view of a dump truck 11 according to an embodiment. In FIG. 1, the vehicle body of the dump truck 11 is supported on front suspensions 17F, 17F which are provided on left and right front wheels 13F, 13F, and on rear suspensions 17R, 17R which are provided on left and right rear wheels 13R, 13R.

An operating room 15 in which a user is mounted is mounted on a front portion of an upper portion of the vehicle body. Furthermore, on a rear portion of the upper portion of the vehicle body, there is mounted a hinge pin 25 around which the body 12 is free to rotate, loaded with a load. The body 12 is rotated in the upward direction and in the downward direction by the extension and retraction of a dump cylinder 16.

Figure 2:
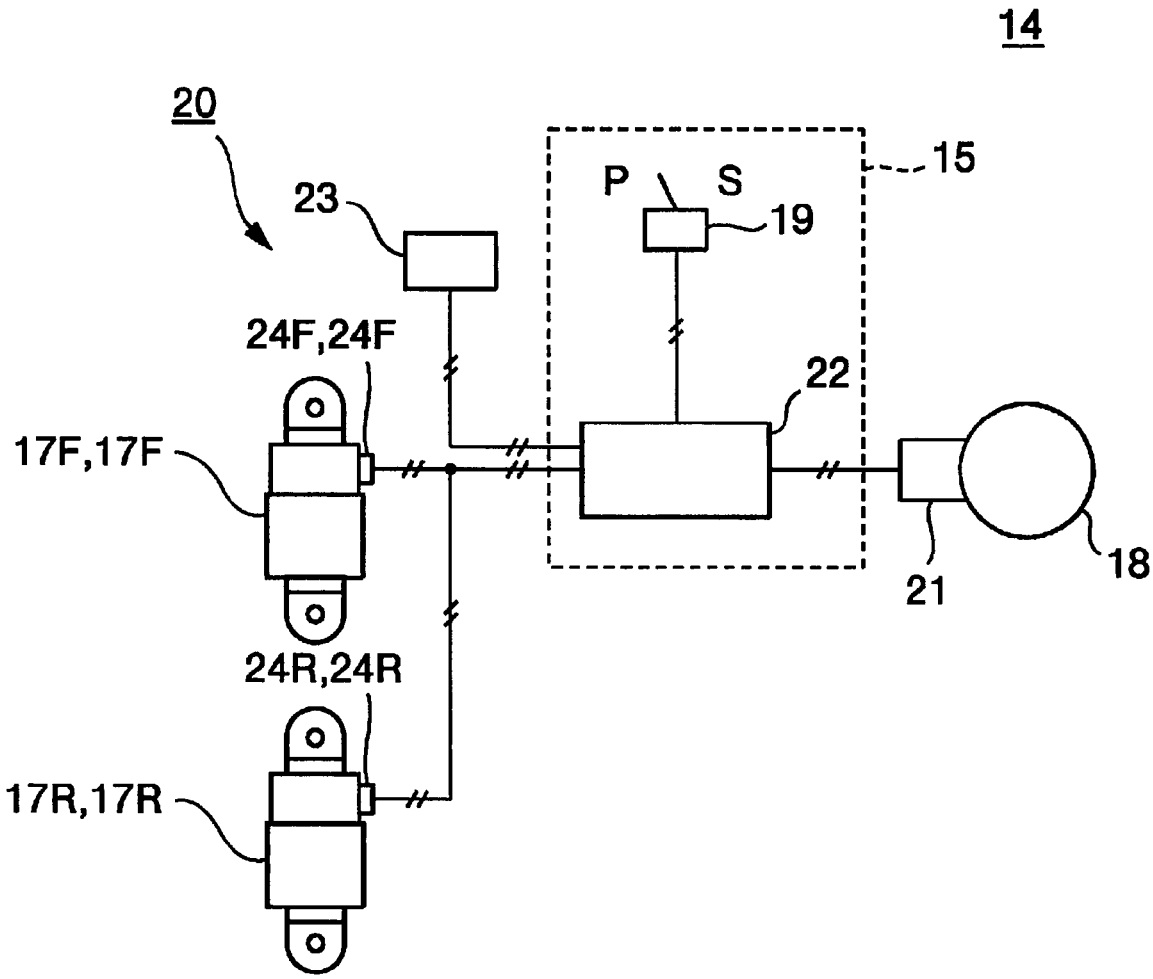
FIG. 2 is a block diagram of an engine output control device according to an embodiment of the present invention.

FIG. 2 is a block diagram of the structure of an output control device 14 for an engine 18. In FIG. 2, the output control device 14 comprises an engine controller 22, a mode setting switch 19 which changes over the output mode, a load detector 20 which detects whether the load of the dump truck 11 is high load or is low load, and a governor 21 which controls the output of the engine 18.

First, the mode setting switch 19 will be explained. The user actuates this mode setting switch 19 manually in the same way as in the prior art, and sets the output mode to either a power mode (P) or a standard mode (S). For example if, during a working process, there is included a process in which it is considered that heavy working is being performed, such as carrying a load or climbing up a slope or the like, then the user sets the mode setting switch 19 to the power mode (P). Furthermore, if it is not the case that a process is being performed in which heavy working is included, then the user sets the mode setting switch 19 to the standard mode (S).

Next, the load detector 20 will be explained. A loaded weight measurement device (a payload meter), for example, may be used as a load detector which detects the weight of the load which is loaded on this dump truck. In detail, this load detector 20 comprises left and right front suspension pressure detectors 24F, 24F which detect the pressures experienced by the left and right front suspensions 17F, 17F respectively, left and right rear suspension pressure detectors 24R, 24R which detect the pressures experienced by the left and right rear suspensions 17R, 17R respectively, and an inclinometer 23 which detects the inclination of the vehicle body.

The engine controller 22 calculates the axle load which is imposed on the suspensions 17F and 17R from the output signals of the suspension pressure detectors 24F and 24R. And it compensates the axle loads which it has thus obtained based on the inclination of the vehicle body which is detected by the inclinometer 23, and detects the weight which is loaded onto the body 12 by obtaining the load imposed on the front and rear wheels 13F and 13R. And, based on the weight of the load which it has detected, the engine controller 22 decides that a load state in which a load greater than a predetermined weight is loaded on the body 12 is high load, and that an unloaded state is low load. It should be understood that, as described hereinafter, it may also be arranged for the calculation of the weight of the load based on the outputs from the suspension pressure detectors 24F and 24R and the inclinometer 23 to be executed by a different controller, with the result thereof being used by the engine controller 22.

Next, the governor 21 will be explained. Based on commands from the engine controller 22, this governor 21 controls the engine 21 so as to have the output characteristic in accordance with the commands by restricting the injection amount of a fuel injection pump or the like.

Figure 3:
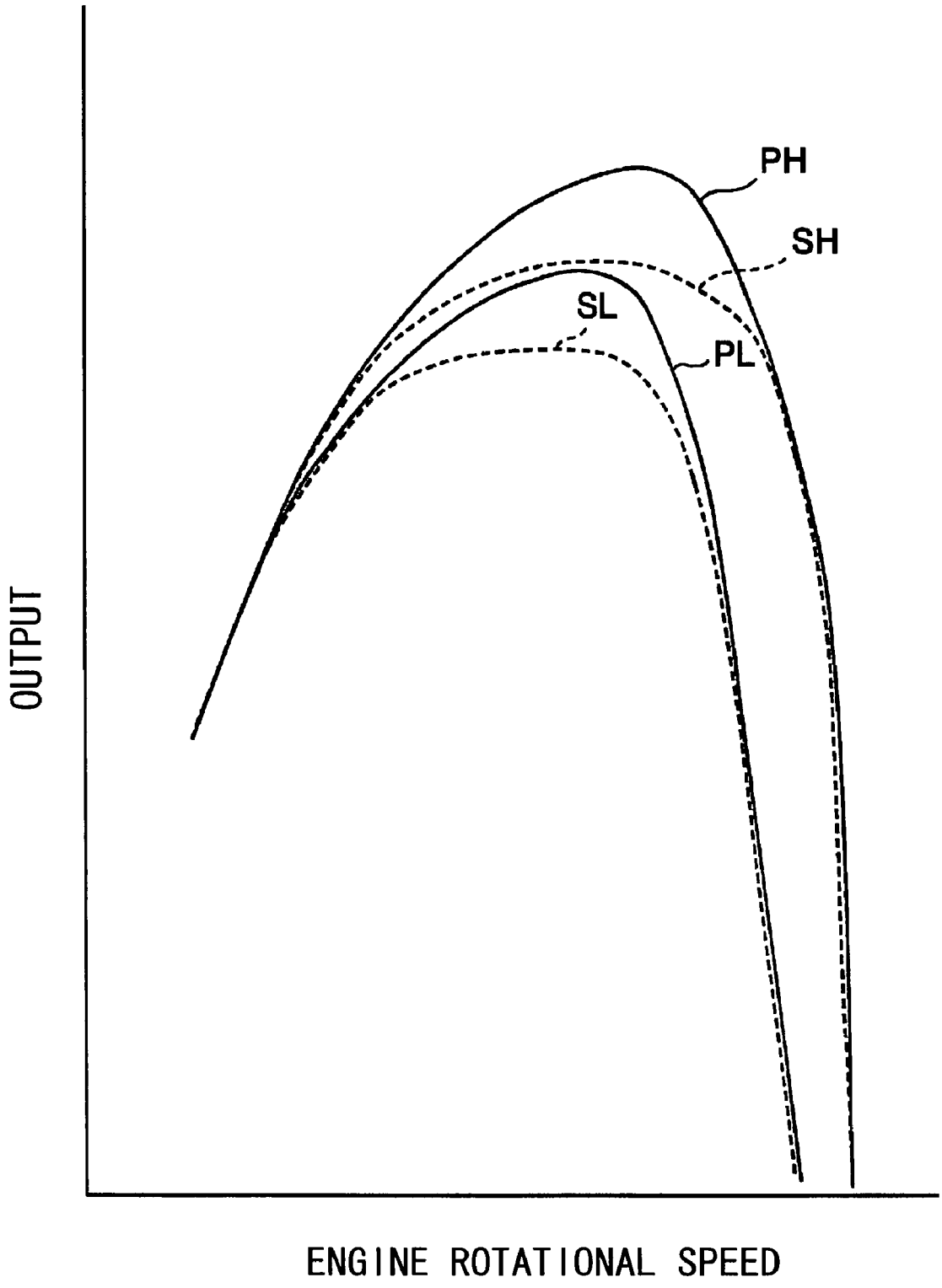
FIG. 3 is a graph showing the output characteristic of an engine, according to an embodiment of the present invention.

FIG. 3 shows a graph of an example of the output characteristic of the engine 18 in this embodiment. In FIG. 3, the horizontal axis is the rotational speed of the engine 18, while the vertical axis is the output of the engine 18. As shown in FIG. 3, the engine controller 22 controls the governor 21, and arranges for the engine 18 to be able to operate according to any one of four engine output characteristics. In the following, "engine output characteristic" will be abbreviated as "output characteristic".

These four output characteristics here are:

1) a high load characteristic (the solid line PH) in the power mode (P);

2) a low load characteristic (the solid line PL) in the power mode (P), in which the engine output is lower than for the high load characteristic in the power mode (P);

3) a high load characteristic (the broken line SH) in the standard mode (S); and 4) a low load characteristic (the broken line SL) in the standard mode (S), in which the engine output is lower than for the high load characteristic in the standard mode (S).

Figure 4:
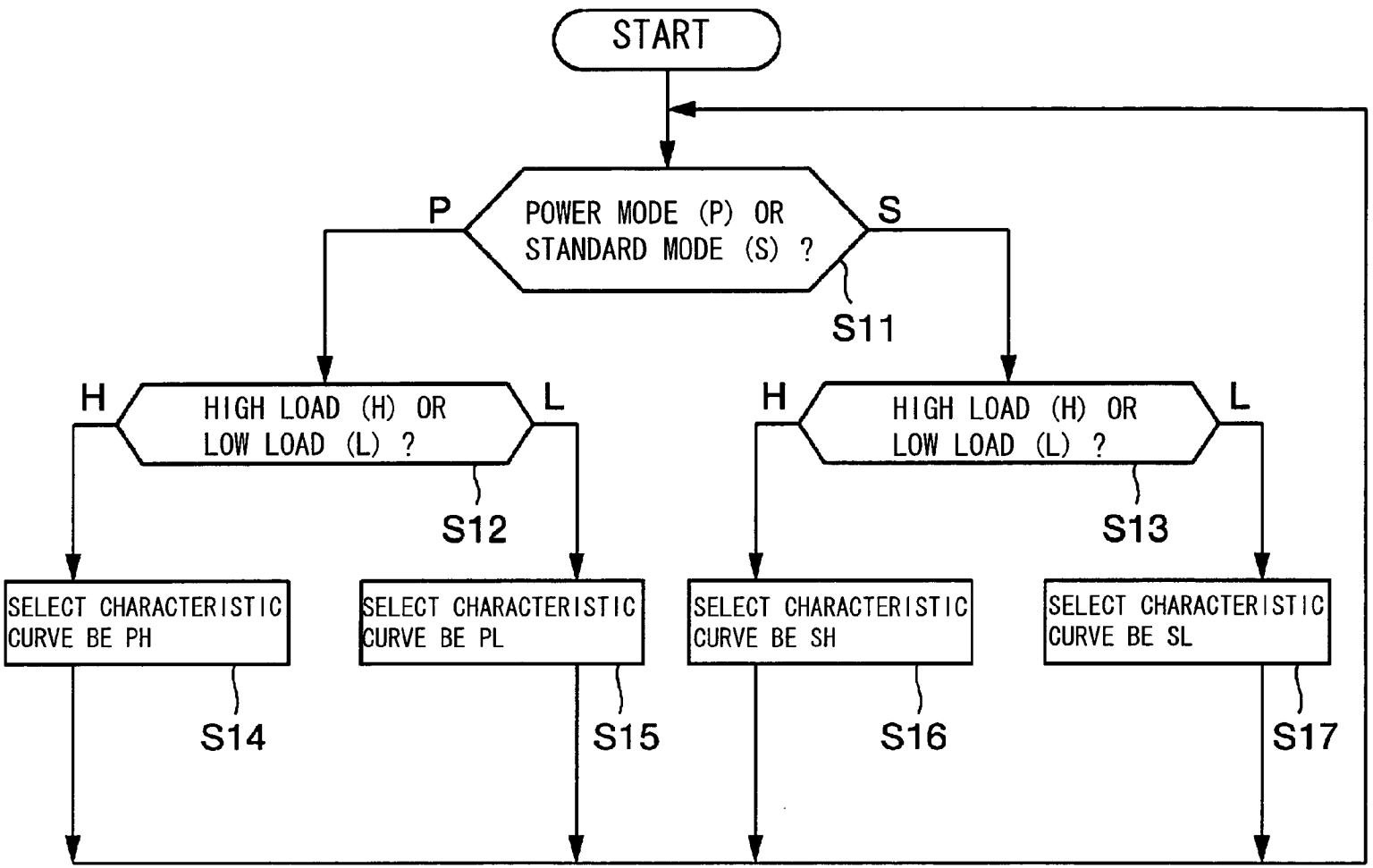
FIG. 4 is a flow chart showing an engine output control procedure according to an embodiment of the present invention.

In the following, the output control for the engine 18 will be explained in detail. FIG. 4 is a flow chart showing an example of the procedure by the engine controller 22 for controlling the engine 18, based on the output signals of the mode setting switch 19 and the load detector 20. In the following, "step" will be abbreviated as "S".

First (S11), the engine controller 22 decides whether the output mode is set to the power mode (P) or is set to the standard mode (S), based on a command by the mode setting switch 19.

If the output mode is set by S11 to the power mode (P), then the engine controller 22 decides (S12) whether the load at this time is high load (H) or low load (L), based on the output signal of the load detector 20.

And, if in S12 it is decided that the load is high load (H), then the engine controller 22 controls (S14) the engine 18 so that the output characteristic of the engine 18 becomes the high load characteristic (the solid line PH). And then the flow of control returns to S11.

Furthermore, if in S12 it is decided that the load is low load (L), then the engine controller 22 controls (S15) the engine 18 so that the output characteristic of the engine 18 becomes the low load characteristic (the solid line PL) in which the output is lower. And then the flow of control returns to S11.

Yet further, if the output mode is set by S11 to the standard mode (S), then the engine controller 22 decides (S13) whether the load at this time is high load (H) or low load (L), based on the output signal of the load detector 20.

And, if in S13 it is decided that the load is high load, then the engine controller 22 controls (S16) the engine 18 so that the output characteristic of the engine 18 becomes the high load characteristic (the broken line SH). And then the flow of control returns to S11.

Furthermore, if in S13 it is decided that the load is low load, then the engine controller 22 controls (S17) the engine 18 so that the output characteristic of the engine 18 becomes the low load characteristic (the broken line SL) in which the output is lower. And then the flow of control returns to S11.

According to the present invention as explained above, first, the user decides, from the overall flow of the work, according to the maximum output which is required for the work, for example, whether high output is required so that the power mode (P) is appropriate, or whether high output is unnecessary so that the standard mode (S) is appropriate, and he sets the mode manually according to the details of the work. By doing this, he is able to obtain an accurate maximum output which is required for the work, and shortage of output during the work does not occur.

Two output characteristics correspond to each of the output modes set. In other words, the high load characteristic (PH) and the low load characteristic (PL) correspond to the power mode (P), while the high load characteristic (SH) and the low load characteristic (SL) correspond to the standard mode (S). The engine controller 22 detects the load of the work, based on the output signal of the load detector 20, and selects one of these output characteristics from among the plurality of output characteristics.

Since, by doing this, the engine 18 performs output at an output characteristic which is matched to the load during working, accordingly it is possible to perform working efficiently, and to reduce the fuel consumption. Moreover, the user does not need to change over the output mode for each type of job, so that it is possible to improve the operability of working.

It should be understood that although, with the graphs shown in FIG. 3, the high load characteristic (the broken line SH) in the standard mode (S) has a higher output than the low load characteristic (the solid line PL) in the power mode (P), this is not to be considered as being limitative. Furthermore although it is shown, in each of the output modes, that two output characteristics correspond thereto, this is also not to be considered as being limitative.

In the following, other examples of output characteristics for the engine 18 are shown in FIGS. 5 through 9 as graphs. In FIGS. 5 through 9, the horizontal axis is the rotational speed of the engine 18, while the vertical axis is the output of the engine 18.

Figure 5:
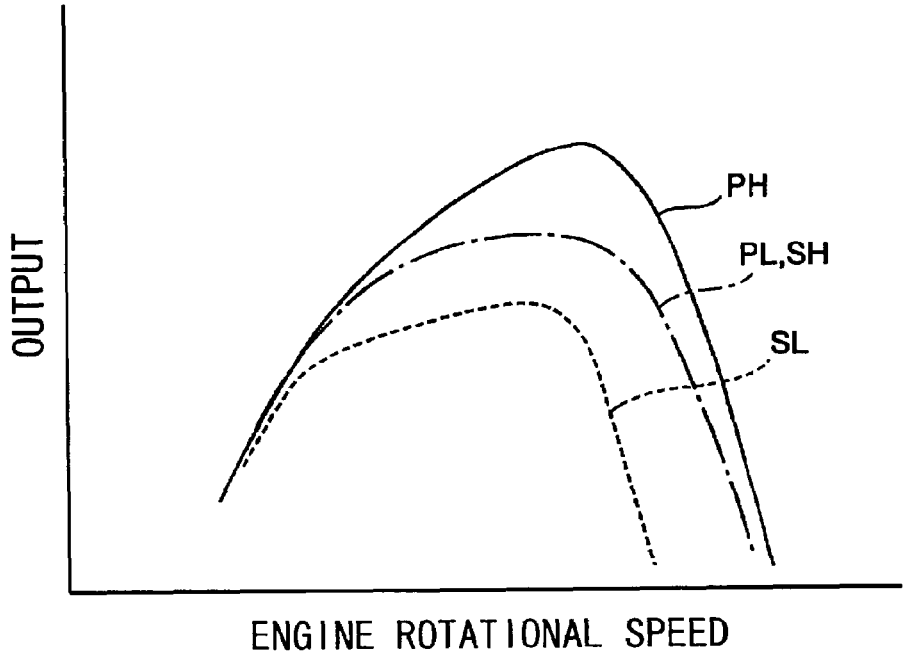
FIG. 5 is a graph showing another example of the output characteristic of an engine, according to an embodiment of the present invention.

In FIG. 5, the engine 18 has three output characteristics. At this time, the low load characteristic (the single dotted broken line PL) in the power mode (P) and the high load characteristic (the single dotted broken line SH) in the standard mode (S) agree with one another.

In other words, when the mode setting switch 19 is set to the power mode (P), the engine controller 22 selects either one from among the two output characteristics (the solid line PH and the single dotted broken line PL) according to the load. That is to say, if the engine controller 22 decides that the load is high load, then it selects the high load characteristic (the solid line PH); while, the engine controller 22 it decides that the load is low load, then if selects the low load characteristic (the single dotted broken line PL).

Furthermore, when the mode setting switch 19 is set to the standard mode (S), the engine controller 22 selects either one from among the two output characteristics (the single dotted broken line SH and the broken line SL) according to the load. That is to say, if the engine controller 22 decides that the load is high load, then it selects the high load characteristic (the single dotted broken line SH); while, if the engine controller 22 decides that the load is low load, then it selects the low load characteristic (the broken line SL).

In this manner, it is also possible to reduce the number of output characteristics which are required by having some from among the plurality of output characteristics in common between different output modes (here, the low load characteristic (the single dotted broken line PL) in the power mode (P), and the high load characteristic (the single dotted broken line SH) in the standard mode (S)).

Figure 6:
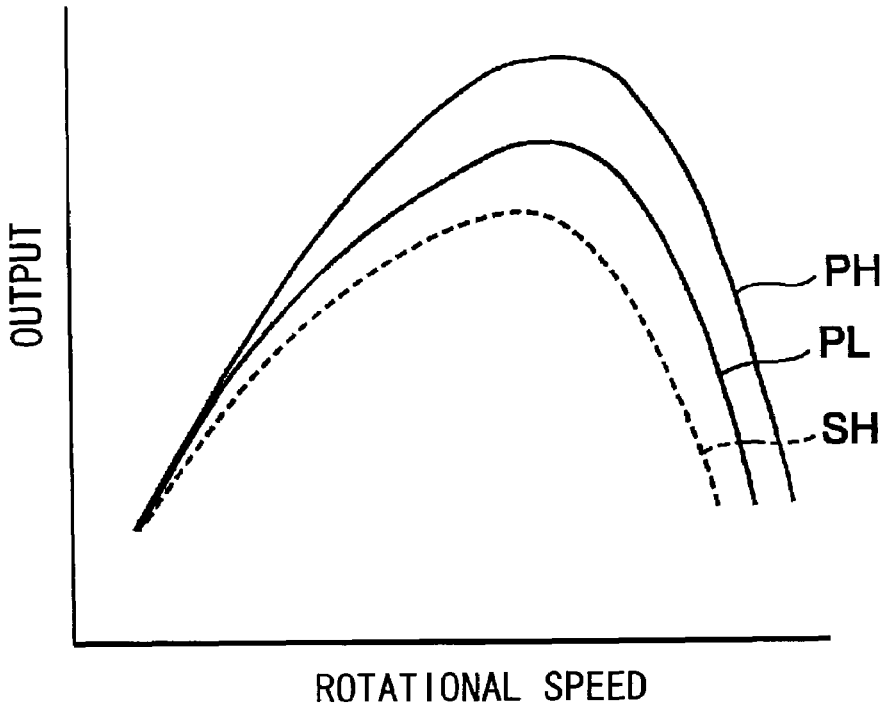
FIG. 6 is a graph showing another example of the output characteristic of an engine, according to an embodiment of the present invention.

In the example shown in FIG. 6, two output characteristics correspond to the power mode (P)—the high load characteristic (the solid line PH) and the low load characteristic (the solid line PL)—while only one output characteristic (the broken line SH) corresponds to the standard mode (S).

In other words, when the power mode (P) is set, one from among the two output characteristics (PH) and (PL) is selected, according to the load. Furthermore, when the standard mode (S) is set, operation is performed according to the single output characteristic (the broken line SH) which corresponds thereto. Or, at this time, it would also be acceptable to make the load characteristic (the solid line PL) in the power mode (P) and the output characteristic (the broken line SH) in the standard mode (S) to agree with one another.

Thus, in this manner, the present invention is not limited to the case in which a plurality of output characteristics always correspond to each output mode; it will be acceptable, provided that a plurality of output characteristics correspond to at least one output mode. If an output mode which corresponds to a plurality of output characteristics is set, the engine controller 22 selects one from among the plurality of output characteristics according to that load.

Figure 7:
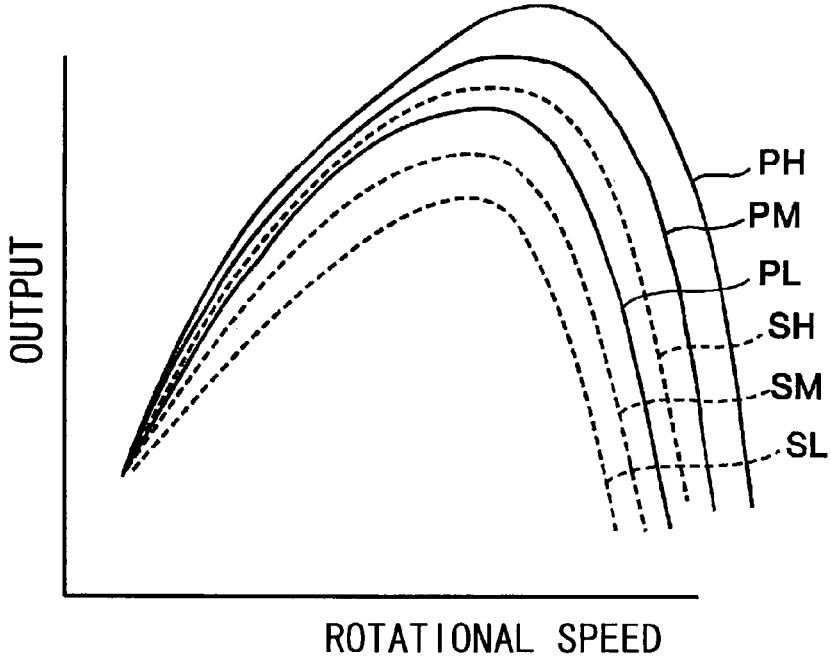
FIG. 7 is a graph showing another example of the output characteristic of an engine, according to an embodiment of the present invention.

In the example shown in FIG. 7, three output characteristics correspond to the power mode (P): a high load characteristic (the solid line PH); a medium load characteristic (the solid line PM); and a low load characteristic (the solid line PL). Furthermore, three output characteristics correspond to the standard mode (S) a high load characteristic (the broken line SH); a medium load characteristic (the broken line SM); and a low load characteristic (the broken line SL).

When the power mode (P) is set, the engine controller 22 selects one from among the three output characteristics (PH, PM, and PL) according to the load. Furthermore, when the standard mode (S) is set, the engine controller 22 selects one from among the three output characteristics (SH, SM, and SL) according to the load.

Figure 8:
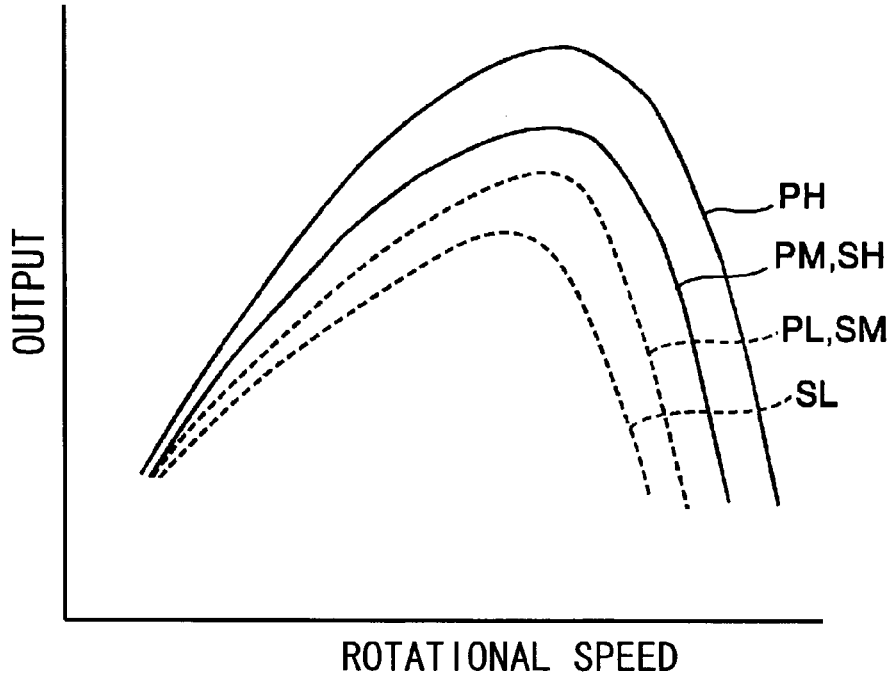
FIG. 8 is a graph showing another example of the output characteristic of an engine, according to an embodiment of the present invention.

At this time, it would be acceptable to make some of these output characteristics agree with one another. For example, as shown in FIG. 8, it would be acceptable to make the medium load characteristic (the solid line PM) in the power mode (P) and the high load characteristic (the broken line SH) in the standard mode (S) agree with one another, or to make the medium load characteristic (the broken line SM) in the standard mode (S) and the low load characteristic (the solid line PL) in the power mode (P) agree with one another.

Figure 9:
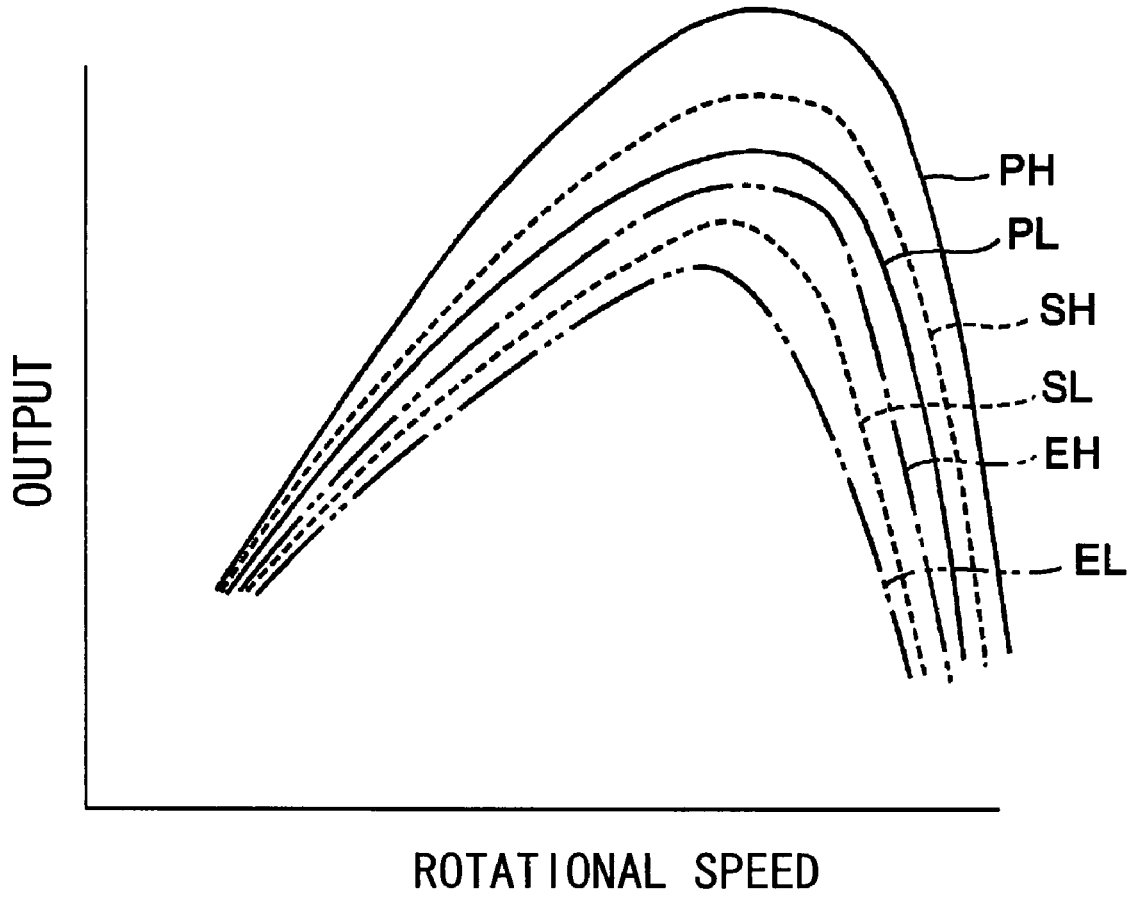
FIG. 9 is a graph showing another example of the output characteristic of an engine, according to an embodiment of the present invention.

In the example shown in FIG. 9, in addition to the two modes which the user is enabled to set with the mode setting switch 19, i.e. the power mode (P) and the standard mode (S), he is also enabled to set an economy mode (E) in which the output mode is yet lower.

And two output characteristics correspond to the power mode (P)—the high load characteristic (the solid line PH) and the low load characteristic (the solid line PL); two output characteristics correspond to the standard mode (S)—the high load characteristic (the broken line SH) and the low load characteristic (the broken line SL); and two output characteristics correspond to the economy mode (E)—the high load characteristic (the double dotted broken line EH) and the low load characteristic (the double dotted broken line EL).

The engine controller 22 selects, according to the output mode which is set, an appropriate one from among these output characteristics in accordance with the load. In other words, if the power mode (P) is set, it selects one from among the output characteristics (PH) and (PL) according to the load; if the standard mode (S) is set, it selects one from among the output characteristics (SH) and (SL) according to the load; and, if the economy mode (E) is set, it selects one from among the output characteristics (EH) and (EL) according to the load. At this time, it would be acceptable to make some of these output characteristics agree with one another, just as in the previously described example.

It should be understood that although, in the above described embodiment, the detection of the load was performed based on the output signals of the suspension pressure detectors 24F and 24R which detected the load, and of the inclinometer 23, this is not to be considered as being limitative. For example, it would also be acceptable to decide that the load was high load if the output signals from the suspension pressure detectors 24F and 24R are greater than predetermined values, without considering the output signal of the inclinometer 23.

Furthermore, it would also be acceptable to provide a potentiometer which detects the angle by which the accelerator of the dump truck 11 is stepped on, and to decide that the load is high when the accelerator is stepped down on. Or, it would also be acceptable to provide an acceleration sensor to the vehicle body of the dump truck 11, and to decide that the load is low during acceleration by an acceleration which is greater than or equal to a predetermined value.

Yet further, it would also be acceptable to arrange to detect the inclination of the vehicle body and the progression direction based on the output signal of the inclinometer 23 and the gear of a transmission not shown in the figures, and to decide that the load is high when the dump truck 11 is climbing up a slope, while otherwise deciding that the load is low. Moreover, it would also be acceptable to arrange to detect the load situation from the output signals of the suspension pressure detectors 24F and 24R, and, by combining the inclination therewith, to decide that the load is high only when climbing up a slope in a loaded state.

And, among these, as has been explained with regard to the above described embodiment, it is more desirable to decide on the load state according to whether the body 12 is in an unloaded state or in a loaded state, based on the output signals of the suspension pressure detectors 24F and 24R. By doing this, changeover is performed between the low load unloaded state and the high load loaded state while the dump truck 11 is stopped, since both loading and unloading of a load are performed while the vehicle is stopped. Accordingly no shock occurs due to changing over of the output characteristic, since the output characteristic is also changed over while the vehicle is stopped, and also it is not necessary to control the governor 21 in order to eliminate such shock.

It should be understood that although, in the above described embodiments, the explanation was made in terms of a dump truck which was taken as an example, the present invention is not to be considered as being limited to this example; it may also be applied in general to a working vehicle.

Furthermore although, in the above described explanation, the case was explained in which, when the user sets the mode setting switch initially, thereafter he does not change it over, the present invention is not to be considered as being limited thereby; sometimes he may also change it over during working, according to requirements.

Embodiment 1

Next, several variant embodiments which are included in the embodiment described above will be explained in detail. FIGS. 10 through 15 show the first of these variant embodiments. In this first variant embodiment, the state of the load which is imposed on the dump truck 11 is determined based on the accelerator opening degree and on the acceleration of the dump truck 11.

Figure 10:
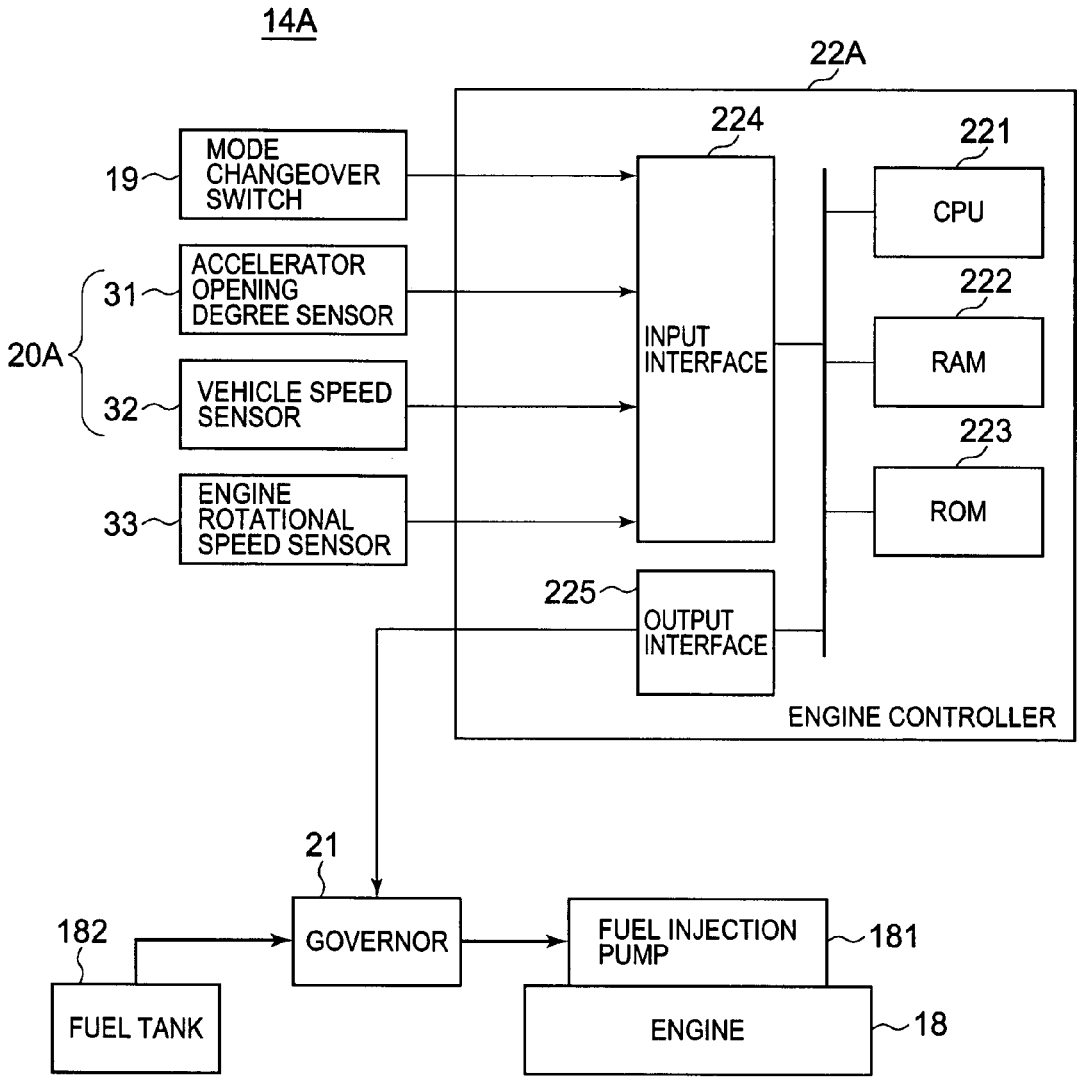
FIG. 10 is a block diagram of an engine output control device, showing a variant example of an embodiment of the present invention.

FIG. 10 is a block diagram of an engine output control device 14A according to this first variant embodiment. This engine controller 22A is a computer device which comprises, for example, a CPU (Central Processing Unit) 221, a RAM (Random Access Memory) 222, a ROM (Read Only Memory) 223, an input interface (abbreviated as "I/F" in the drawing) 224, and an output interface 225.

A map T1 for determining the load state (which will be described hereinafter along with FIG. 11), programs for executing an engine output control procedure, and the like are stored in advance in the ROM 222. The CPU 221 performs predetermined control by reading in and executing programs which are stored in the ROM 222. The RAM 222 is a common storage region for the CPU 221 to work.

To the input interface 224, in addition to a mode changeover switch 19, there are connected an accelerator opening degree sensor 31, a vehicle speed sensor 32, and an engine rotational speed sensor 33. The accelerator opening degree sensor 31 is a device which detects the amount of stepping on of the accelerator pedal, and which outputs this as an electric signal. For example, a structure may be employed in which a sensor such as a potentiometer or the like is provided to the accelerator pedal, so that the stepping on amount of the accelerator pedal is detected directly. Or, it would also be acceptable to employ a structure in which the displacement is detected of some other portion which changes according to actuation of the accelerator pedal, such as, for example, the opening degree of a throttle valve, so that the stepping amount of the accelerator pedal is detected indirectly.

The vehicle speed sensor 32, along with the accelerator opening degree sensor 31, constitute a load detector 20A of this first variant embodiment. This vehicle speed sensor 32 detects the moving speed of the dump truck 11, based on, for example, the rotation of an output shaft of the transmission, or the like. An engine controller 22A calculates the rate of change per unit time of the vehicle speed signal which is input from the vehicle speed sensor 32, and thereby obtains the acceleration of the dump truck 11. Accordingly, instead of the vehicle speed sensor 32, it would also be acceptable to utilize an accelerator sensor which is capable of detecting the acceleration of the dump truck 11 directly.

The engine rotational speed sensor 33 is a device which detects the rotational speed of the engine 18, and outputs it as an electrical signal. This engine rotational speed sensor 33 may consist, for example, of an electromagnetic pickup which detects the rotation of a gear of a flywheel.

The output interface 225 outputs a control signal to the electronic governor 21. The governor 21 supplies fuel within the fuel tank 182 to the fuel injection pump 181 based on the control signal from the engine controller 22A. When the fuel injection amount increases the output of the engine 18 increases, while, when the fuel injection amount decreases, the output of the engine 18 also decreases.

Figure 11:
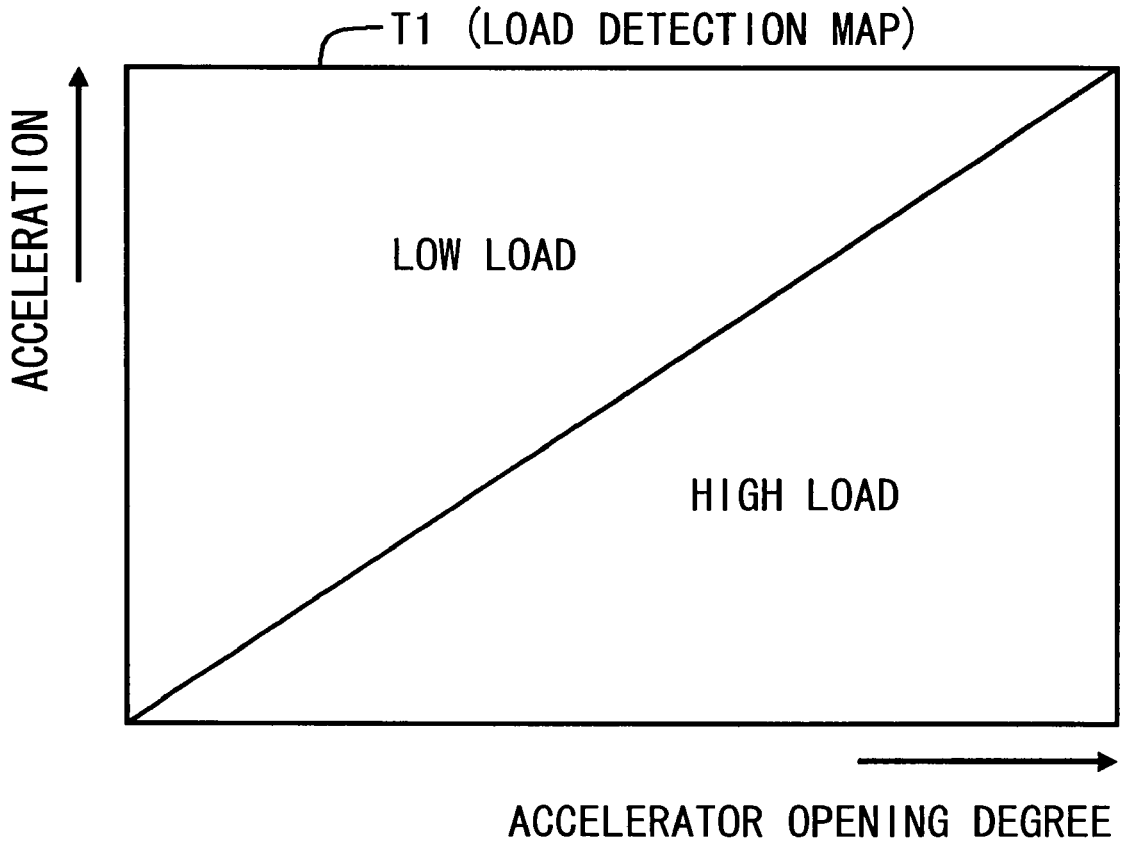
FIG. 11 is a load detection map for determining whether the load on a working vehicle is high load or low load.

FIG. 11 is an explanatory figure schematically showing a map T1 for load detection, for determining whether the load state of the dump truck 11 is the high load state or the low load state. This map T1 is made as a two dimensional map in which the accelerator opening degree is shown along one coordinate axis and the acceleration is shown along the other coordinate axis.

And the right lower half of the map T1 is set to the high load region, while the left upper half of the map T1 is set to the low load region. Accordingly, by referring to the map T1 based on the current accelerator opening degree and acceleration of the dump truck 11, it is possible to determine in a simple manner whether the load state of the dump truck 11 is the high load state or the low load state.

It should be understood that the high load region and the low load region which are shown in the map T1 are shown as one example for determining the load state from the accelerator opening degree and the acceleration; the present invention is not limited to the map T1 shown in FIG. 11. How the high load region and the low load region are set, may be determined according to the type of the working vehicle (the model or the cylinder capacity of the dump truck 11, the details of the work, or the like). Furthermore, it would also be acceptable to arrange to provide a load detection map for the power mode and a load detection map for the standard mode separately.

Figure 12:
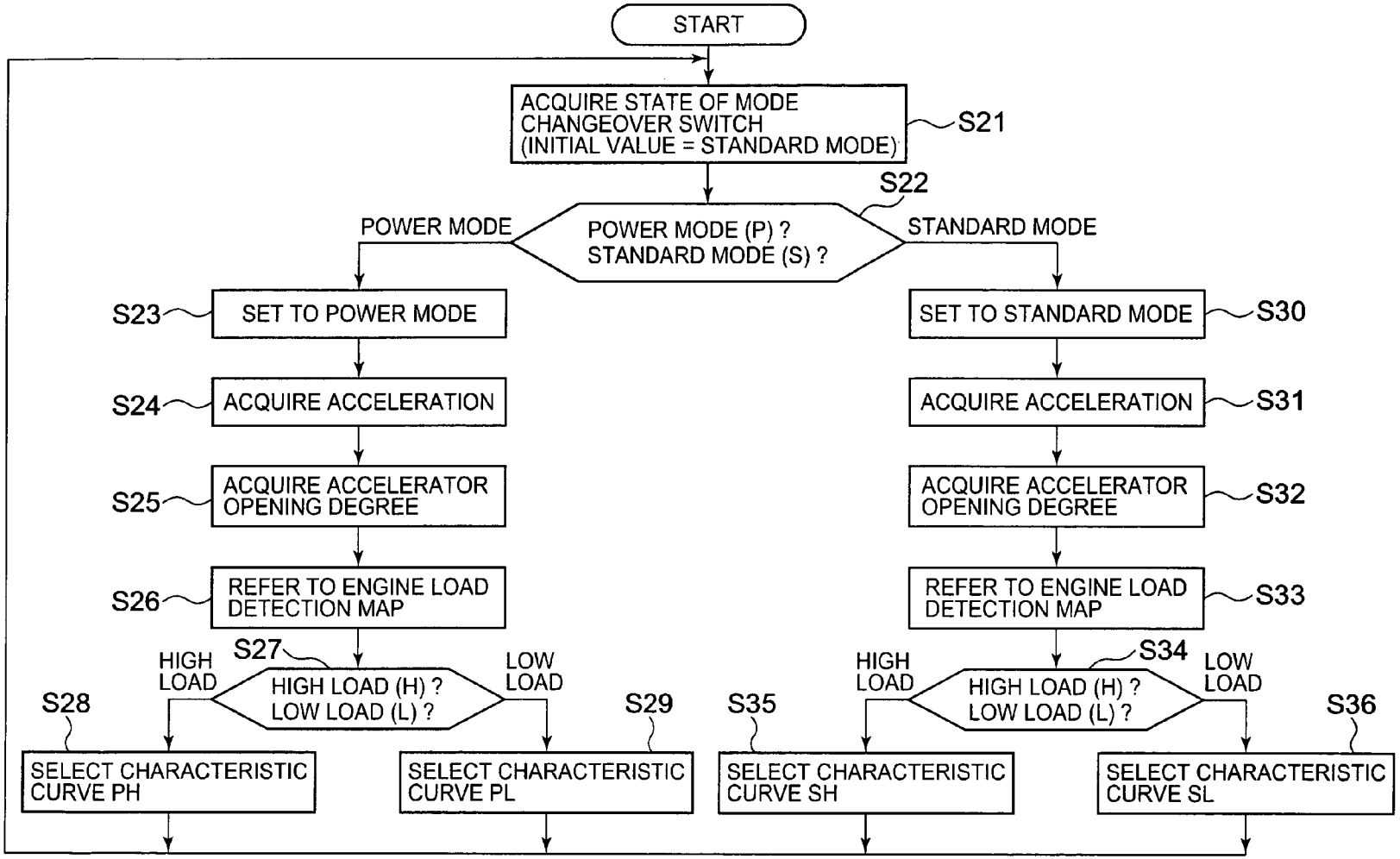
FIG. 12 is a flow chart showing an engine output control procedure according to a variant embodiment of the present invention.

FIG. 12 is a flow chart showing an engine output control procedure according to this first variant embodiment. The engine controller 22A reads in the state of the mode changeover switch 19 (S21), and decides which of the power mode and the standard mode is set (S22).

If, for example, the mode setting switch 19 is constituted as a switch whose set state is maintained mechanically, as with a toggle switch or a see-saw switch or the like, then it will be sufficient for the engine controller 22A to read in its current set state. By contrast if, for example, the mode setting switch 19 is constituted as an electronic type switch such as a touch panel or the like, then the engine controller 22A sets the standard mode as the initial value of the output mode (S21).

When the user selects the power mode, the engine controller 22A sets the output mode to the power mode (S23). And, along with the engine controller 22A obtaining the acceleration based on the signal from the vehicle speed sensor 32 (S24), it also acquires the accelerator pedal opening degree based on the signal from the accelerator pedal opening degree sensor 31 (S25). The engine controller 22A refers to the map T1 based on the acceleration and the accelerator pedal opening degree (S26), and makes a decision as to whether the dump truck 11 is in high load or is in low load (S27).

If it is decided that the current state is high load, then the engine controller 22A selects the high load output characteristic PH belonging to the power mode (S28). Conversely, if it is decided that the current state is low load, then the engine controller 22A selects the low load output characteristic PL belonging to the power mode (S29).

On the other hand, when the user selects the standard mode, or when the standard mode is set as the initial value without the user performing any explicit setting, then the engine controller 22A sets the output mode to the standard mode (S30).

And, in the same manner as above, the engine controller 22A acquires both of the acceleration and the accelerator pedal opening degree (S31, S32), refers to the map T1 (S33), and makes a decision as to whether the dump truck 11 is in high load or is in low load (S34). And, if it is decided that the current state is high load, then the engine controller 22A selects the high load output characteristic SH belonging to the standard mode (S35). Conversely, if it is decided that the current state is low load, then the engine controller 22A selects the low load output characteristic SL belonging to the standard mode (S36). In this manner the load on the dump truck 11, in the output mode which is selected by the user, is determined based on the accelerator pedal opening degree and the acceleration, and an output characteristic is selected according to the load which is decided on.

Figure 13:
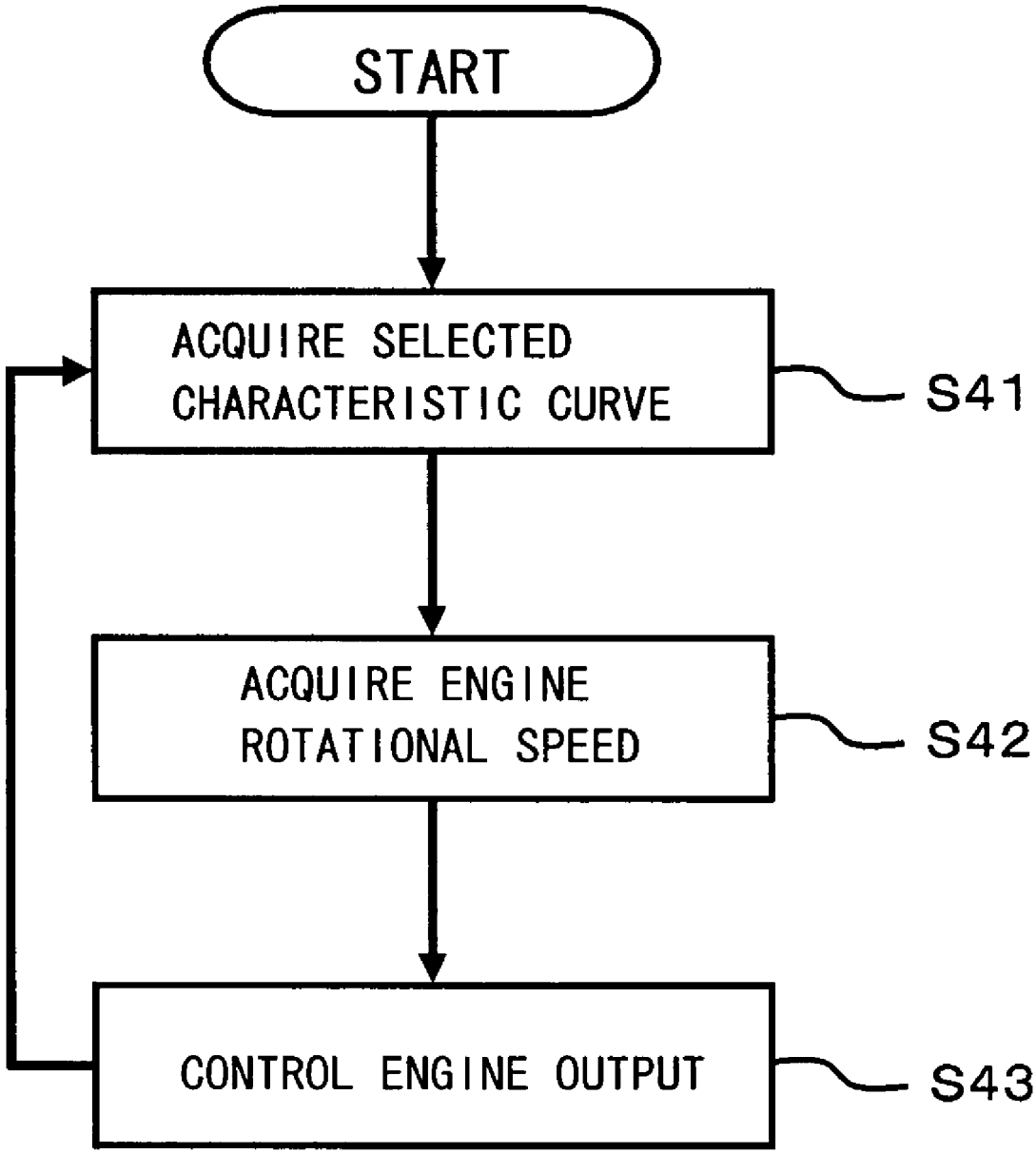
FIG. 13 is a flow chart relating to a variant embodiment, and showing a method for controlling the output of an engine according to an output characteristic which is set.

FIG. 13 is a flow chart schematically showing a procedure for controlling the output of the engine according to the output characteristic which is selected. The engine controller 22A acquires (S41) the output characteristic which is selected (in the figure, the "characteristic curve"), and then acquires the engine rotational speed from the engine rotational speed sensor 33 (S42). And the engine controller 22A calculates the actuation amount for the governor 21 which is required in order to implement an engine output corresponding to the present engine rotational speed, and outputs a control signal for actuating the governor 21 (S43). Due to this, the governor 21 adjusts the fuel amount which is injected from the fuel injection pump 181.

Figure 14:
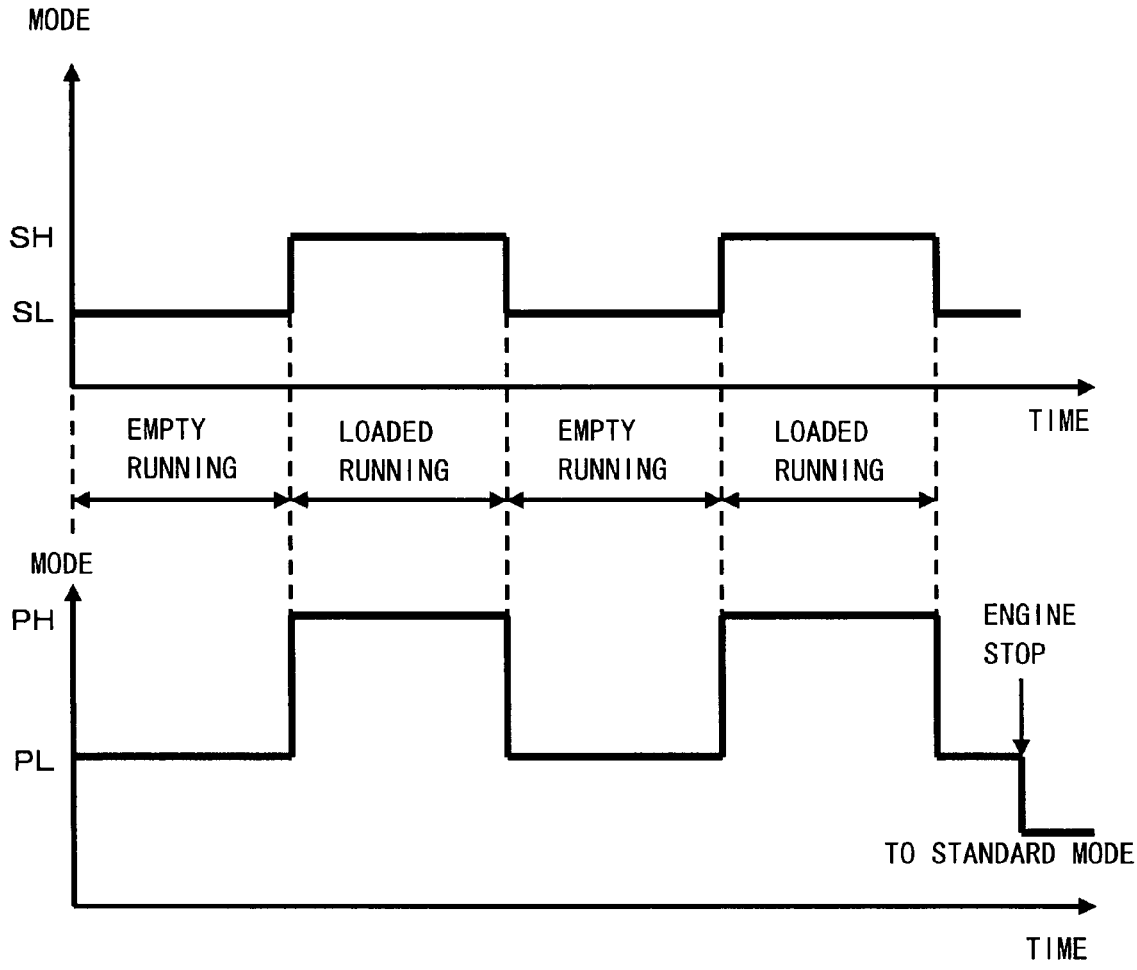
FIG. 14 is a time chart, schematically showing a situation in which the output characteristic is changed over according to the working cycle of the working vehicle.
Figure 15:
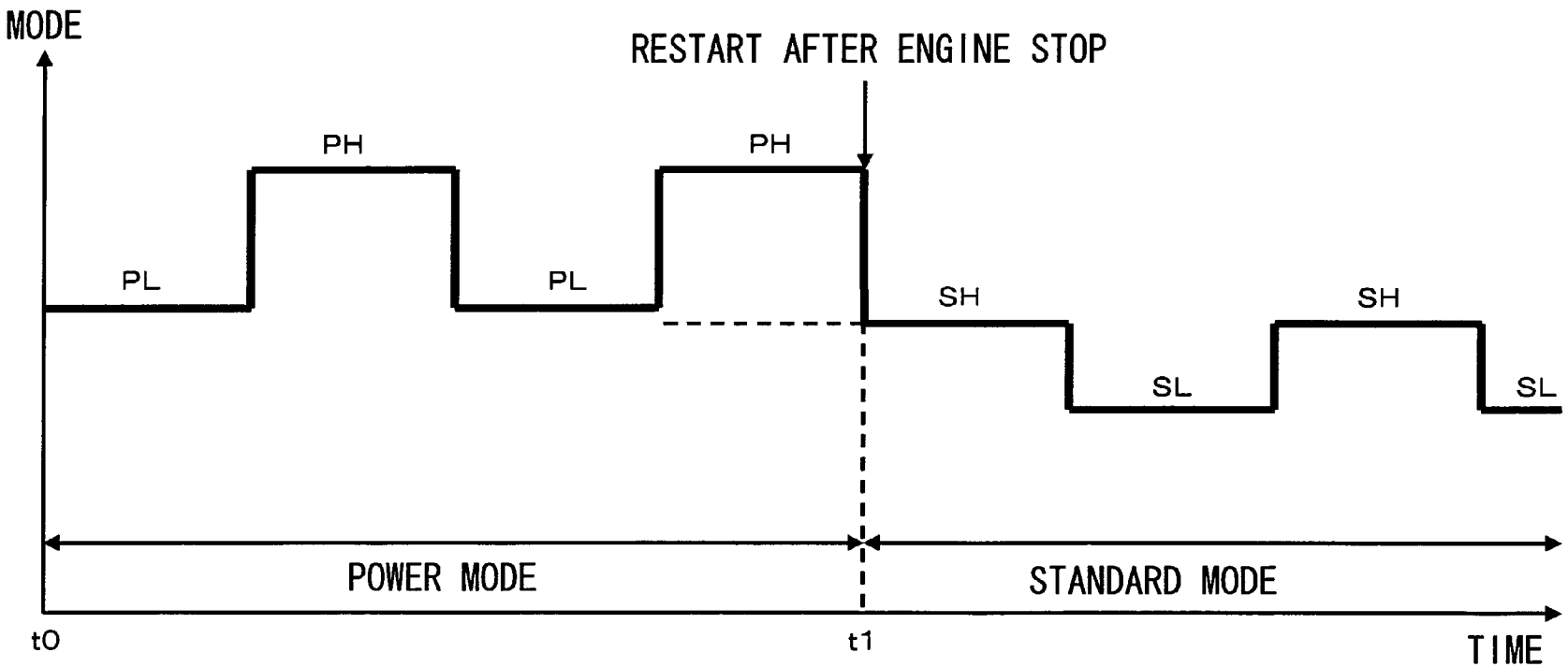
FIG. 15 is a time chart, schematically showing a situation in which a changeover to standard mode is performed automatically when the engine is restarted.

FIG. 14 is a time chart showing the situation in which the high load output characteristic and the low load output characteristic are automatically changed over according to the details of the work. The upper side in FIG. 14 shows the case of the standard mode, while the lower side in FIG. 14 shows the case of the power mode.

As described above, during loading, after a load such as earth or the like is charged, the dump truck 11 drives towards a dumping location, and discharges the load at that dumping location. Then the dump truck 11, which now has become empty, again returns to the point of loading and takes on another load. If this type of sequence of taking on a load→loaded driving→load discharge→empty running is taken as being one cycle, then this cycle is repeated a plurality of times. During loaded running in the state in which a load is taken on, the dump truck 11 may be determined as operating in the high load state. Conversely, during empty running when the dump truck 11 is being driven in the state in which its load is discharged, it may be determined that the dump truck 11 is in the low load state.

Accordingly, in the case of the standard mode, during empty running, engine output control is performed in which the amount of fuel consumption is restricted based on the low load output characteristic SL; while, during loaded running, engine output control is performed based on the high load output characteristic SH, in order to obtain the required output.

In the same manner, in the case of the power mode, during empty running, the engine output control is performed based on the low load output characteristic PL, while during loaded running the engine output control is performed based on the high load output characteristic PH.

And if the engine 18 is stopped in the situation in which the power mode is selected, the system shifts to the standard mode, which is set as the initial value. This situation will now be explained with reference to the time chart of FIG. 15.

Initially, it is supposed that the user selects the power mode and performs work. In a working environment such as one in which high load and low load are changed over alternatingly, the high load output characteristic PH and the low load output characteristic PL belonging to the power mode are changed over automatically. And, when the user has restarted the engine 18 after having temporarily stopped it, the engine controller 22A sets the standard mode as the initial mode value.

Accordingly, provided that the user does not actuate the mode changeover switch 19 and change over to the power mode, the output of the engine 18 is controlled based on the standard mode. By doing this, if the working demand can be sufficiently satisfied by the standard mode, as for example when the amount of the load is comparatively small and also the vehicle is not being driven up a slope, then it is possible to prevent the occurrence of a state of affairs in which the dump truck 11 is operated over a long time period with the power mode continuously set. This is because, when the engine is restarted, the standard mode is set with priority as the initial mode value. If the user feels a shortage of output power, then, at this time point, the user may actuate the mode changeover switch 19, and may thus change over from the standard mode to the power mode.

With this first variant embodiment having this type of structure, it is possible to obtain the same beneficial operational effects as with the embodiment above described. In other words it is possible, while suppressing useless fuel consumption as much as practicable, also to obtain the necessary engine output for performing the required work, and it is also possible to anticipate compatibility of both improvement of the fuel consumption and also maintenance of the workability.

Embodiment 2

Figure 16:
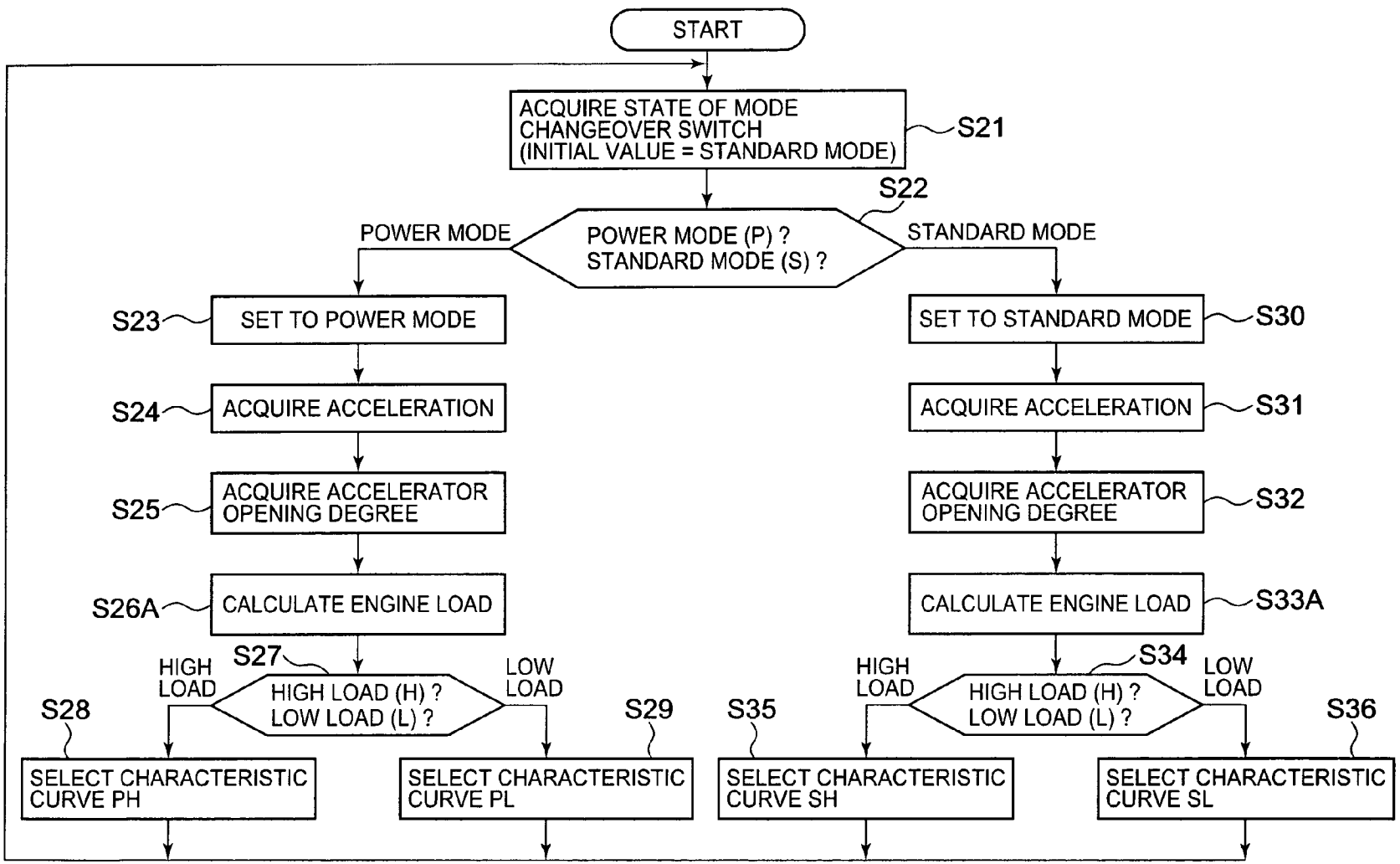
FIG. 16 is a flow chart showing an engine output control procedure according to another variant embodiment.

FIG. 16 is a flow chart showing an engine output procedure according to a second variant embodiment of this embodiment. In this second variant embodiment, instead of the map T1, the load on the dump truck 11 is determined based on a calculation equation which is prepared in advance.

The flow chart shown in FIG. 16 has certain steps in common with the flow chart of FIG. 12, and only S26A and S33A are different. Thus, to explain these contrasting steps, the engine controller 22A determines the load on the dump truck 11 (S26A and S33A) by performing a predetermined calculation based on the acceleration and the accelerator pedal opening degree.

For example, if $\alpha$ denotes the acceleration, $\theta$ denotes the opening degree of the accelerator pedal, and F denotes the calculation equation, then, by comparing the value L which is obtained by $F(\alpha, \theta)$ ($L=F(\alpha, \theta)$) with a threshold value Th which is set in advance, it is possible to decide whether the dump truck 11 is in the high load state ($L \geqq Th$) or is in the low load state ($L<Th$). With the second variant embodiment structured in this manner, as well, the same beneficial operational effects may be obtained, as with the above described embodiments.

Embodiment 3

Figure 17:
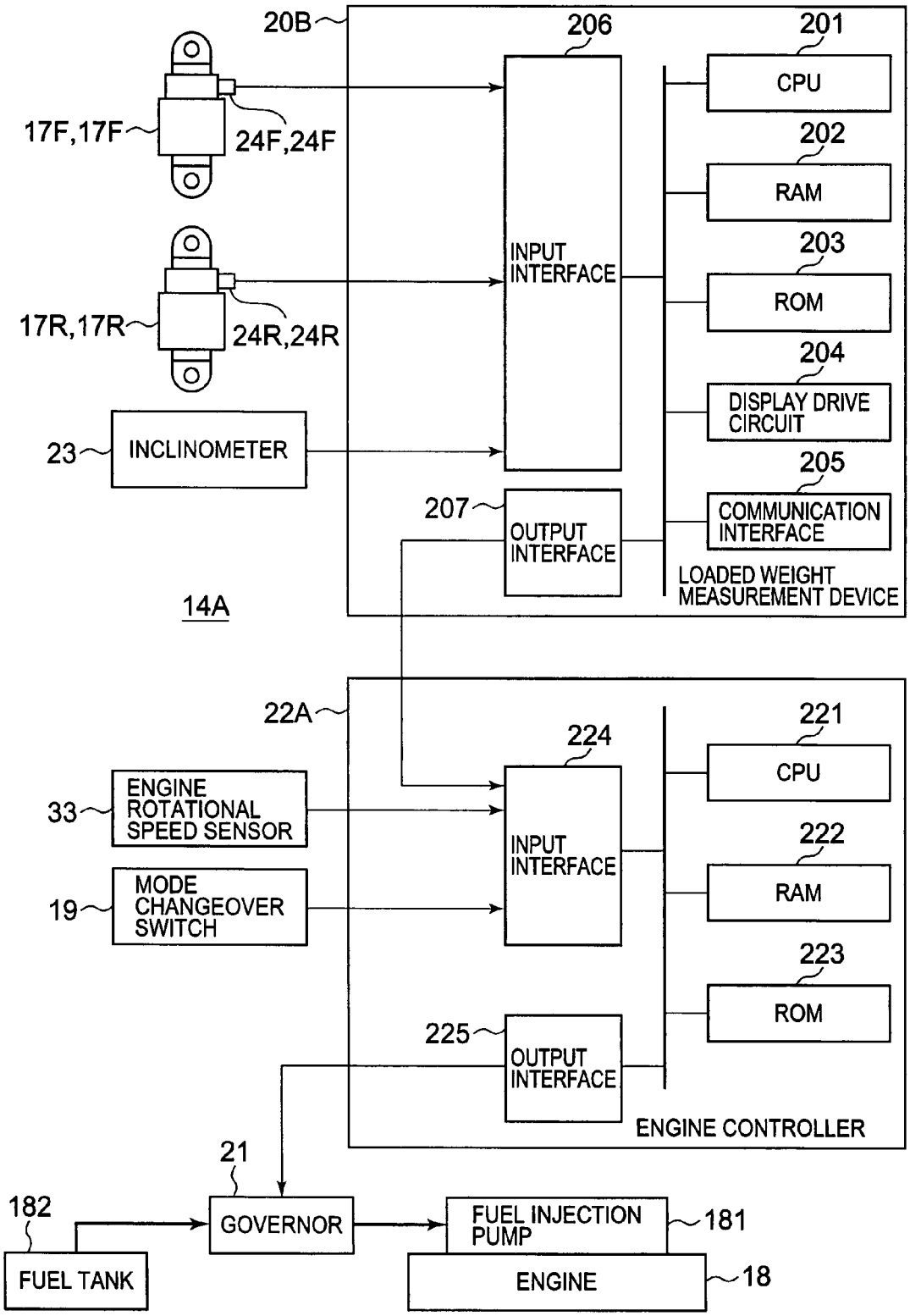
FIG. 17 is a block diagram showing an engine output control device according to yet another variant embodiment.

A third variant embodiment will be explained based on FIGS. 17 and 18. With this third variant embodiment, a loaded weight measurement device 20B is employed as a load detector. This loaded weight measurement device 20B may be constructed as a computer device which comprises, for example, a CPU 201, a RAM 202, a ROM 203, a display drive circuit 204, a communication interface 205, an input interface 206, and an output interface 207.

Suspension pressure detectors 24F and 24R and an inclinometer 23 are connected to the input interface 206. The output interface 207 is connected to the input interface 224 of the engine controller 22A.

The method of calculation of the loaded weight W by the loaded weight measurement device 20B will now be explained.

Denoting the pressure at the top chambers of the suspension cylinders by Pt and the pressure at their bottom chambers by Pb, the suspension pressure detectors 24F and 24R respectively detect these pressures Pt and Pb and output signals representative thereof.

And the loaded weight measurement device 20B performs the calculation $F=K\times(PT\times St-Pb\times Sb)$ for each of the suspension units 17F and 17R. Here, K is a coefficient, while St is the pressure receiving area of the top chamber and Sb is the pressure receiving area of the bottom chamber.

By doing this, the loads F1, F2, F3, and F4 which are acting on each of the suspension cylinders are calculated. F1 and F2 are the loads which act on the front suspensions 17F, while F3 and F4 are the loads which act on the rear suspensions 17R. Furthermore, with regard to the loads F3 and F4 which act on the rear suspensions 17R, they are adjusted based on the angle of inclination of the vehicle body as detected by the inclinometer 23, so that they become adjusted loads Fa3 and Fa4.

And, first, the total weight Wo (F1+F2+Fa3+Fa4) in the unloaded state is measured, and is stored. Next, the total weight Wt in the loaded state is measured, and the loaded weight W is obtained as the difference (Wt−Wo) between it and the total weight Wo in the unloaded state. The loaded weight W which is measured in this manner is input into the engine controller 22A.

And the engine controller 22A determines whether the dump truck 11 is in the high load state or in the low load state based on the loaded weight which is thus input from the loaded weight measurement device 20B, and changes over between the high load output characteristic and the low load output characteristic for the output mode which is currently selected.

Figure 18:
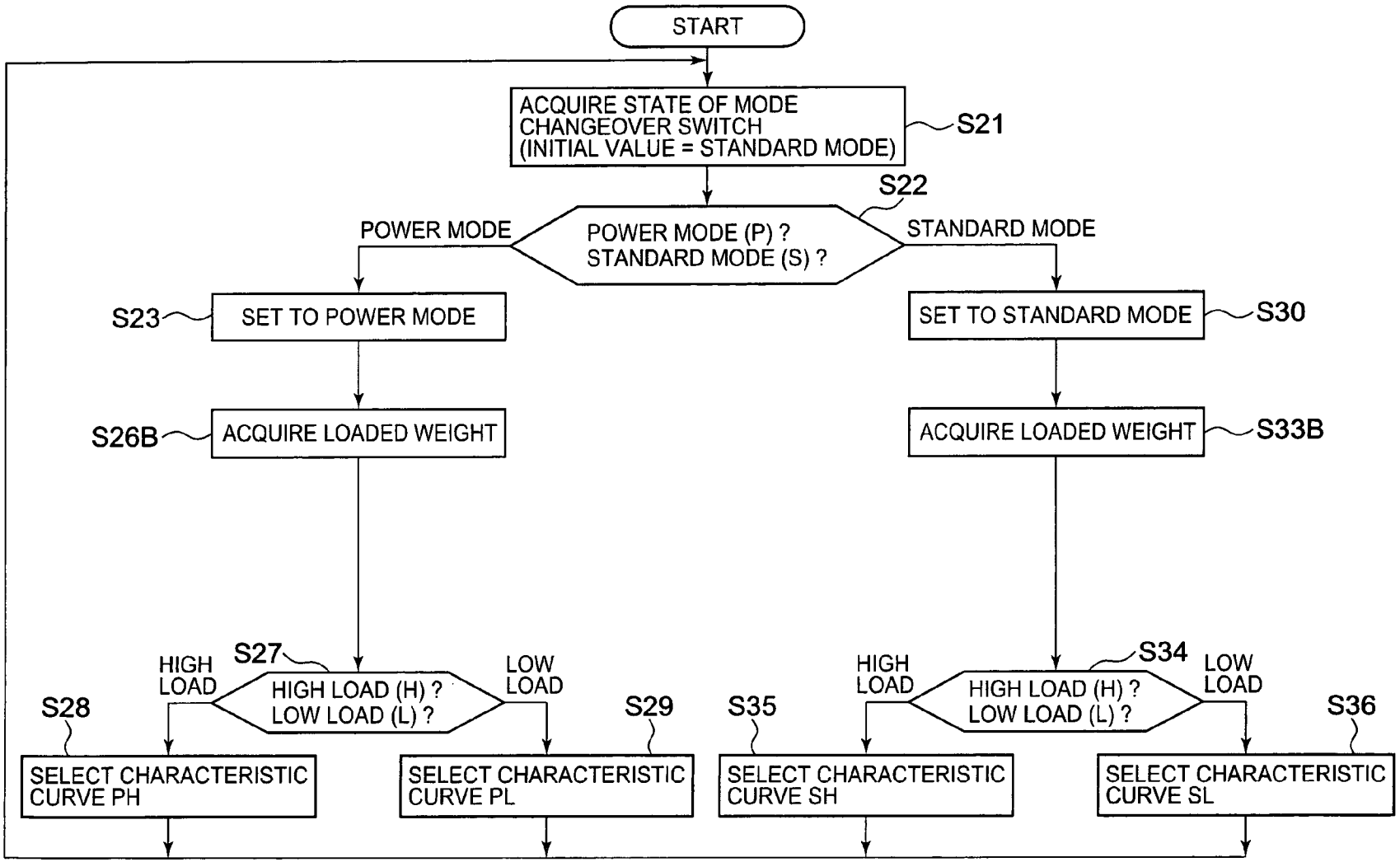
FIG. 18 is a flow chart showing an engine output control procedure according to another variant embodiment.

FIG. 18 is a flowchart showing the engine output control method according to this third variant embodiment. This flow chart has certain steps in common with the flow chart of FIG. 12, and only the steps S26B and S33B are different. Thus, to explain these contrasting steps, the engine controller 22A determines the load on the dump truck 11 (S26B and S33B) based on the loaded weight, as calculated by the loaded weight measurement device 20B. With this third variant embodiment structured in this manner, as well, the same beneficial operational effects may be obtained, as with the above described embodiments.

Although embodiments of the present invention have been described above, these embodiments are only given by way of example for explanation of the present invention, and the range of the present invention is not to be considered as being limited only to those embodiments. The present invention may be implemented in various other different manners, provided that its gist is not departed from.

The invention claimed is:

1. An engine output control device for a working vehicle, comprising:

a mode setting switch which can set any one from among a plurality of output modes;

a load detector which detects a load on said working vehicle; and an engine controller which controls an engine based on any one engine output characteristic selected from among a plurality of engine output characteristics which are prepared in advance;

wherein said engine controller makes said plurality of engine output characteristics corresponding to at least one output mode among said plurality of output modes, and if an output mode which is made corresponding to said plurality of engine output characteristics is set by said mode setting switch, said engine controller selects any one among said plurality of engine output characteristics based on magnitude of said load which is detected by said load detector.

2. The engine output control device for a working vehicle according to claim 1, wherein said load detector detects said load based on pressure of a suspension of said working vehicle.

3. The engine output control device for a working vehicle according to claim 1, wherein said load detector detects weight of a load which is loaded on said working vehicle as said load.

4. The engine output control device for a working vehicle according to claim 3, wherein said load detector comprises a loaded weight measurement device which measures the weight of said load which is loaded on said working vehicle, based on pressures applied to each of a plurality of suspension cylinders of said working vehicle, and on vehicle body angle of said working vehicle.

5. The engine output control device for a working vehicle according to claim 1, wherein said load detector detects said load based on an accelerator opening degree and acceleration of said working vehicle.

6. The engine output control device for a working vehicle according to claim 5, wherein said load detector detects said load by utilizing information for load detection in which a high load region and a low load region are set in advance, based on a relationship between said accelerator opening degree and said acceleration.

7. The engine output control device for a working vehicle according to claim 1, wherein:

said output modes include a first output mode in which an engine output is relatively increased and a second output mode in which the engine output is relatively decreased;

in said first output mode, at least a first high load engine output characteristic, which is used when said detected load is high load, and a first low load engine output characteristic, which is used when said detected load is low load, and in which the engine output is decreased below the engine output in said first high load engine output characteristic, are made corresponding; and in said second output mode, at least a second high load engine output characteristic, which is used when said detected load is high load, and a second low load engine output characteristic which is used when said detected load is low load, and in which the engine output is decreased below the engine output in said second high load engine output characteristic, are made corresponding.

8. The engine output control device for a working vehicle according to claim 7, wherein said engine controller sets said second output mode as initial value when said engine is started, and, if said mode setting switch is actuated by a user, said engine controller sets an output mode, among said first output mode and said second output mode, which is selected by said user.

9. An engine output control method for a working vehicle, comprising:

a load on said working vehicle is detected, and a plurality of output modes which can be selected by a user are provided;

a plurality of engine output characteristics are made corresponding to at least one output mode among said plurality of output modes; and when an output mode which is made corresponding to said plurality of engine output characteristics is selected by said user, any one of said plurality of engine output characteristics is selected based on magnitude of the load which is detected.

10. An engine output control method for a working vehicle, characterized in that a plurality of engine output characteristics are made corresponding in advance to a first output mode in which an engine output is relatively increased and a second output mode in which said engine output is relatively decreased, respectively, and comprising a step of detecting load on said working vehicle, when said first output mode is selected by a user;

a step of, when said detected load belongs to a high load which is set in advance, setting a first high load engine output characteristic which is made corresponding in advance to said first output mode;

a step of, when said detected load belongs to a low load which is set in advance, setting a first low load engine output characteristic which is made corresponding in advance to said first output mode, and in which the engine output is decreased below the engine output in said first high load engine output characteristic;

a step of detecting said load on said working vehicle, when said second output mode is selected by said user;

a step of, when said detected load belongs to a high load which is set in advance, setting a second high load engine output characteristic which is made corresponding in advance to said second output mode; and a step of, when said detected load belongs to a low load which is set in advance, setting a second low load engine output characteristic which is made corresponding in advance to said second output mode, and in which the engine output is decreased below the engine output in said second high load engine output characteristic.

* * * * *